US005956914A

United States Patent [19]

Williamson

[11] Patent Number: 5,956,914

[45] Date of Patent: Sep. 28, 1999

[54] VINYL SIDING PANELS FOR BUILDING EXTERIORS

[76] Inventor: David L. Williamson, 4052 FM 3364, Princeton, Tex. 75407

[21] Appl. No.: 09/072,829

[22] Filed: May 5, 1998

[51] Int. Cl.[6] ..... E04D 1/00

[52] U.S. Cl. ..... 52/520; 52/526; 52/529; 52/519; 52/523; 52/546; 52/543

[58] Field of Search ..... 52/520, 526, 529, 52/530, 532, 525, 519, 523, 544, 546, 535, 521, 522, 543, 587.1, 592.1, 539, 211, 212, 204.53, 204.54

[56] References Cited

U.S. PATENT DOCUMENTS

| | | | |
|---|---|---|---|
| D. 366,534 | 1/1996 | McMahon . | |
| 1,654,120 | 12/1927 | Ewing . | |
| 4,320,613 | 3/1982 | Kaufman | 52/521 |
| 4,435,938 | 3/1984 | Rutkowski et al. . | |
| 4,712,351 | 12/1987 | Kasprzak . | |
| 5,022,207 | 6/1991 | Hartnett | 52/526 X |
| 5,074,093 | 12/1991 | Meadows . | |
| 5,284,693 | 2/1994 | Spain et al. . | |
| 5,347,784 | 9/1994 | Crick et al. | 52/520 |
| 5,387,381 | 2/1995 | Saloom . | |
| 5,423,153 | 6/1995 | Woolems et al. . | |
| 5,424,118 | 6/1995 | McLaughlin | 52/592.1 X |
| 5,444,954 | 8/1995 | Anderson | 52/211 X |
| 5,506,031 | 4/1996 | Spain et al. . | |
| 5,517,794 | 5/1996 | Wagner | 52/544 X |
| 5,537,792 | 7/1996 | Moliere | 52/535 X |
| 5,560,170 | 10/1996 | Ganser et al. | 52/546 X |
| 5,586,422 | 12/1996 | Hoffner . | |
| 5,625,992 | 5/1997 | Strick et al. | 52/212 X |
| 5,651,227 | 7/1997 | Anderson | 52/520 |
| 5,675,955 | 10/1997 | Champagne | 52/520 X |

*Primary Examiner*—Carl D. Friedman
*Assistant Examiner*—Brian E. Giessner

[57] ABSTRACT

Disclosed is an improved vinyl siding panel for building exteriors that covers an increased surface area and is configured such that the time, effort and complexity of its installation is greatly reduced in comparison to that of conventional vinyl siding products. The siding panel consists of large rectangular panels that are used in conjunction with a variety of trim and corner moldings to cover the building surface.

10 Claims, 9 Drawing Sheets

VINYL SIDING PANELS FOR BUILDING EXTERIORS

BACKGROUND OF THE INVENTION

1. Field of the Invention

The present invention relates generally to exterior coatings for buildings and the like and, more particularly, to vinyl siding panels for building exteriors that cover an increased surface area and are easy to install, thus reducing the time and effort required for installation.

2. Description of the Related Art

Over the years, it has become an increasingly popular practice to cover the exterior surfaces of buildings, especially dwellings, with aluminum or vinyl siding in order to protect the building exterior and provide a durable, long-lasting and aesthetically pleasing finish. Produced in a wide variety of colors and textures, conventional aluminum and vinyl siding consists of long strips, between six and twelve inches in height, that are attached to the building horizontally. The elongated strips are formed such that adjacent strips interlock with one another, creating a sealed seam in between. The strips are cut to appropriate lengths and angles, if necessary, in order to conform with the contour of the building and to account for openings such as windows and doors. Special moldings, designed to accept the siding strips, are used to trim corners and edges as well as door and window frames.

Covering the exterior of a building with conventional siding is a difficult and time-consuming process that usually requires installation by a qualified professional. Cutting the strips to match the contour of the door frames, window frames, roof peaks, gables and abutting wall surfaces requires skill and experience in order to produce quality results that are both durable and aesthetically pleasing. Maintaining parallelism between the strips is essential to ensure proper appearance and layout. Furthermore, special equipment is required to cut and trim the strips to the appropriate lengths and angles.

As a result, installation of conventional aluminum or vinyl siding by the average homeowner is impractical due to the inherent complexities and the requirement of specialized tools. Although the homeowner can reduce the cost of professional installation by as much as fifty percent or more, the added cost of special tools and complexity of the work offsets the savings and greatly reduces the feasibility of personal installation as a viable alternative.

The present invention solves these and many other problems by providing vinyl siding panels for building exteriors that are rectangular in shape, cover an increased surface area and are easy to install, thus reducing the amount of time and effort required. The panels are manufactured so as to exhibit the same visual qualities available in many conventional sidings, such as woodgrain, log, brick, stucco and other materials of varying textures and colors. Installed adjacent to one another, the panels are designed to minimize the presence of seams between one another in order to create a homogeneous layer on the building exterior.

In the ancillary art, several materials and methods have been developed in order to create coverings for exterior building surfaces. U.S. Pat. No. 5,074,093, issued in the name of Meadows and U.S. Pat. No. 4,712,351, issued in the name of Kasprzak, disclose conventional vinyl siding designs consisting of extruded planks with pre-formed slots and grooves that accept and mate with adjacent siding segments. The siding planks are installed horizontally across the building exterior surface in abutting rows. In both the Meadows and the Kasprzak inventions, problems exist in that installation involves procedures that require special skill on the part of the installer and specialized tools for use in sizing and cutting the planks to fit the contour of the building. The present invention serves to reduce the amount of skill, time and effort required on the part of the installer and is therefore an improvement over the prior art devices disclosed in the Meadows and Kasprzak patents. The Meadows and Kasprzak patents do not address these issues and do not preclude the present invention.

U.S. Pat. No. 5,506,031, issued in the name of Spain et al. and U.S. Pat. No. 5,387,381, issued in the name of Saloom, disclose methods for extruding vinyl siding and the like in varying colors and textured patterns. The present invention is not intended to, nor does it teach, the manufacturing methods used to produce the vinyl siding panels for building exteriors. Therefore, the Spain and Saloom inventions do not anticipate nor preclude the present invention.

U.S. Pat. No. 1,654,120, issued in the name of Ewing, discloses an early attempt to create a "log cabin" look using wooden planks, with a rounded outer surface, to cover the exterior of a dwelling. In the Ewing patent, the planks are arranged in an interlocking manner, with round end pieces protruding where two walls meet at a corner, in order to create the appearance that entire logs rather than a contoured planks were used in the construction. This disclosure does not incorporate sophisticated interlocking mechanisms and does not require the use of specialized tools and the like. However, it does require the installer to apply custom carpentry methods, such as coping, joining and shaping, in order to fit adjacent pieces and navigate the contour of the building. Furthermore, the Ewing invention does not address the problems associated with the time and effort associated with applying the covering in plank form.

U.S. Pat. No. 5,586,422, issued in the name of Hoffner and U.S. Pat. No. 5,423,153, issued in the name of Woolems et al., disclose simulated log siding for buildings in which long strips whose surfaces resemble wooden logs are attached to the exterior surface of a building in order to create a "log cabin" appearance. The siding disclosed in the Hoffner patent are constructed of vinyl, aluminum or steel whereas the siding disclosed in the Woolems patent are constructed of wood or vinyl. As with the Ewing patent, the planks are arranged in an interlocking manner, with round end pieces protruding where two walls meet at a corner, in order to create the appearance that entire logs rather than a contoured planks were used in the construction. The interlocking means incorporated in both the Hoffner and the Woolems disclosure consist of preformed slots and grooves that accept and mate with adjacent siding segments. These joining methods add to the complexity of the installation and indicates the degree to which increased surface area coverage of the present invention provides a dramatic improvement over the Hoffner and Woolems inventions. Furthermore, the aluminum, steel and vinyl embodiments of the Hoffner and Woolems inventions require the use of specialized cutting tools and jigs. The present invention eliminates the need for these devices. Accordingly, neither the Hoffner nor the Woolems inventions anticipate and therefore do not preclude the present invention.

A search of the previous art did not disclose any patents that read directly on the claims of the instant invention. Consequently, a need has been felt for an exterior wall covering for buildings that produces the same protective and aesthetic qualities as conventional aluminum or vinyl siding while reducing the installation complexity and requisite skill level of the installer and eliminating the need for specialized tools, thus making possible installation by the homeowner.

SUMMARY OF THE INVENTION

It is therefore an object of the present invention to provide a vinyl siding panel for building exteriors that covers a greater surface area than do the plank or strip type configurations of conventional vinyl siding.

It is another object of the present invention to provide a vinyl siding panel for building exteriors that reduces the amount of effort required to attach the siding to the exterior of a building.

It is another object of the present invention to provide a vinyl siding panel for building exteriors in which the means by which adjacent panels are attached to one another is less complex than that of conventional vinyl siding.

It is another object of the present invention to provide a vinyl siding panel for building exteriors that includes a means by which the trim around windows, doors, in corners and in other areas where non-coplanar surfaces meet that is easy to install and work with.

It is another object of the present invention to provide a vinyl siding panel for building exteriors that eliminates the need for specialized tools to apply the siding.

It is another object of the present invention to provide a vinyl siding panel for building exteriors that can be cut and shaped to conform with the contour of the building surface with ordinary cutting tools such as saws, utility knives and other like devices.

It is another object of the present invention to provide a vinyl siding panel for building exteriors that can be produced in a variety of colors.

It is another object of the present invention to provide a vinyl siding panel for building exteriors that can be produced in a variety of textures and designs, such as woodgrain, log, brick, stucco and other like materials.

It is another object of the present invention to provide a vinyl siding panel for building exteriors that shields and protects the building exterior from sunlight, rain, snow and other like deteriorating substances.

It is another object of the present invention to provide a vinyl siding panel for building exteriors that will remain secured to the building exterior in inclement weather situations.

Finally, it is an object of the present invention to provide a vinyl siding panel for building exteriors that provides enhanced insulating qualities.

Briefly described according to a preferred embodiment, the present invention consists of improved vinyl siding panels for building exteriors that cover an increased surface area and are easy to install, thus reducing the time and effort required for installation. The panels consist of large sheets, a size approximately equivalent to that of standard building materials such as plywood, i.e. four feet by eight feet. The panels are constructed of the same type of materials as that of conventional vinyl siding and are manufactured so as to exhibit the same visual qualities available in many conventional sidings, such as woodgrain, log, brick, stucco and other materials of varying textures and colors.

The siding panels are installed using the same type of securing means, such as nails or screws, that are used to attach conventional aluminum and vinyl siding. Integrated tongue and groove as well as tab and slot connecting means are incorporated into the panels in order to allow adjacent pieces to be secured to one another in a simple yet effective manner. Special molding is used to provide support and cover seams around windows and doors as well as in corners and edges. Stabilizing support brackets are used to further secure the panels to the structure.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

Figure 1:
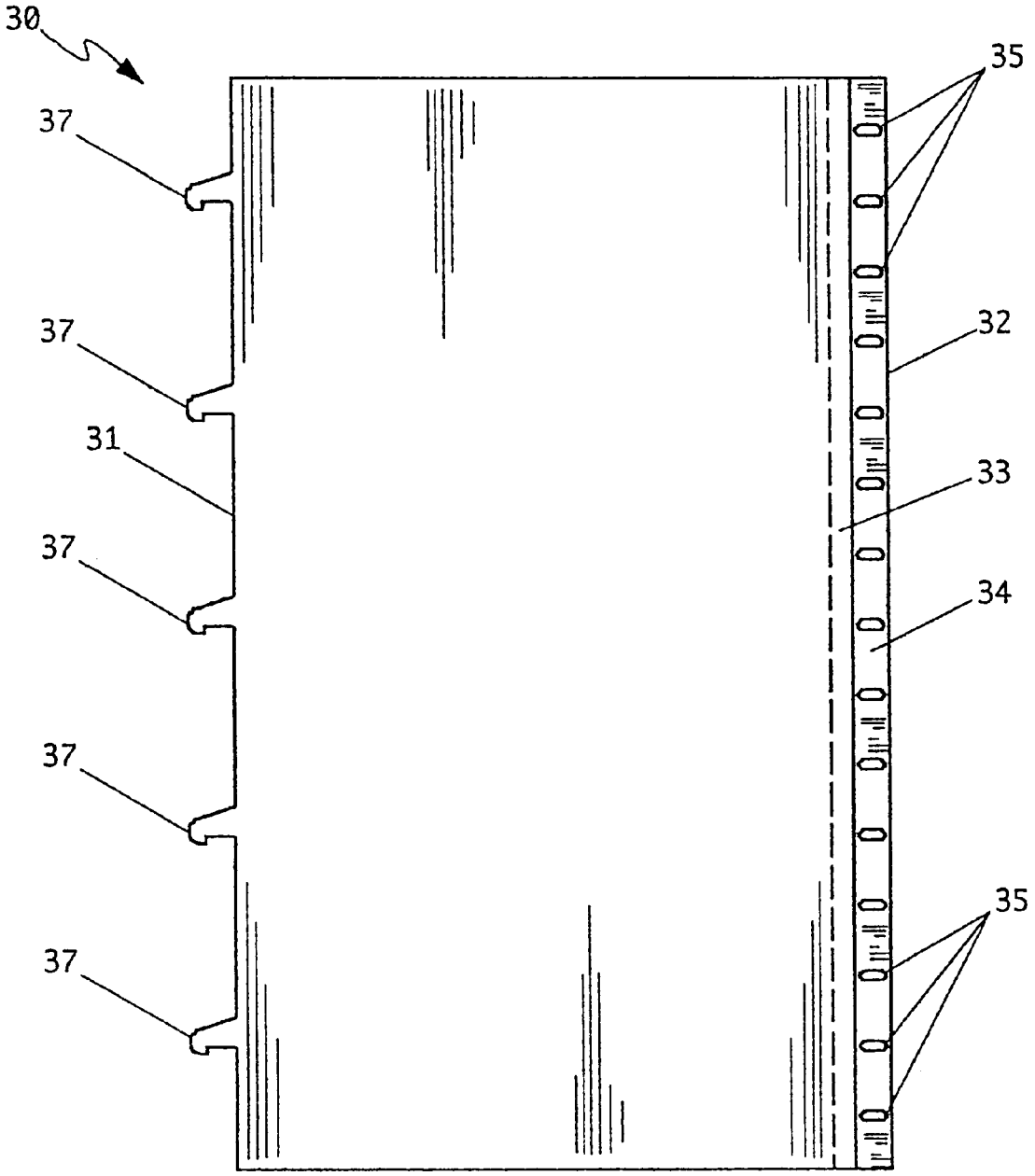
FIG. 1 is a front view of the vinyl siding panel for building exteriors according to the preferred embodiment of the present invention.
Figure 2:
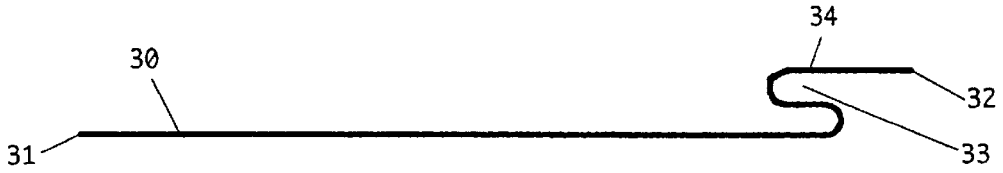
FIG. 2 is a top view of the vinyl siding panel for building exteriors according to the preferred embodiment of the present invention.
Figure 3:
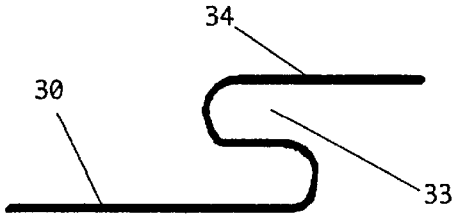
FIG. 3 is a magnified top breakaway view of the vinyl siding panel for building exteriors according to the preferred embodiment of the present invention.
Figure 4:
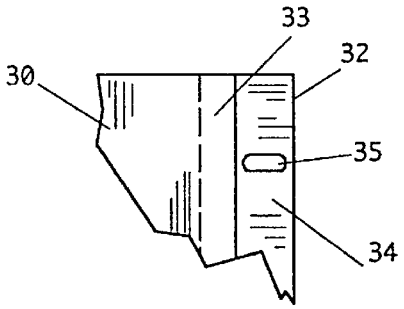
FIG. 4 is a magnified front breakaway view of the vinyl siding panel for building exteriors according to the preferred embodiment of the present invention.
Figure 5:
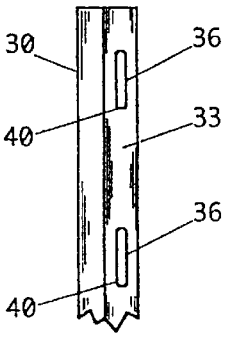
FIG. 5 is a magnified right side breakaway view of the vinyl siding panel for building exteriors according to the preferred embodiment of the present invention.
Figure 6:
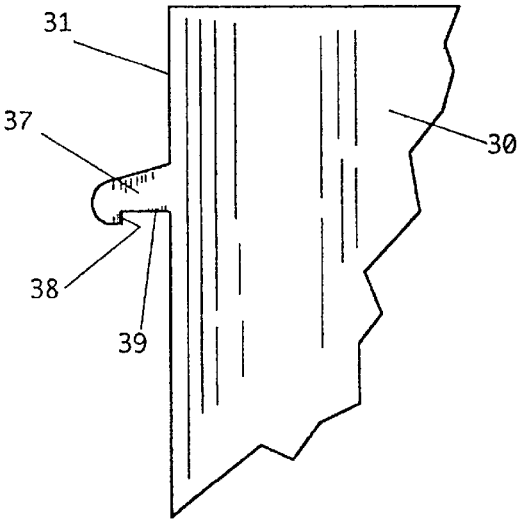
FIG. 6 is a magnified left side breakaway view of the vinyl siding panel for building exteriors according to the preferred embodiment of the present invention.

| LIST QF REFERENCE NUMBERS | |
|---|---|
| 30 | Siding Panel |
| 31 | Inserting Edge |
| 32 | Siding Panel Receiving Edge |
| 33 | Siding Panel Receiving Groove |
| 34 | Siding Panel Nailing Tab |
| 35 | Nailing Slots |
| 36 | Tab Slots |
| 37 | Securing Tabs |
| 38 | Securing Surface |
| 39 | Supporting Surface |
| 40 | Tab Slot Support Edge |
| 50 | Molding Strip |
| 51 | Molding Strip Receiving Groove |
| 52 | Molding Strip Nailing Tab |
| 55 | Outside Corner Molding Stnp |
| 56 | Outside Corner Molding Strip Receiving Groove |
| 57 | Outside Corner Molding Strip Nailing Tab |
| 60 | Inside Corner MoIding#Strip |

-continued

| LIST QF REFERENCE NUMBERS | |
|---|---|
| 61 | Inside Corner Molding Strip Receiving Groove |
| 62 | Inside Corner Molding Strip Nailing Tab |
| 65 | Bottom Stabilizing Bracket |
| 66 | Bottom Bracket Connecting Edge |
| 67 | Bottom Bracket Supporting End |
| 68 | Bottom Bracket Receiving Groove |
| 70 | Top Stabilizing Bracket |
| 71 | Top Bracket Connecting Edge |
| 72 | Top Bracket Supporting End |
| 73 | Top Bracket Receiving Groove |
| 75 | First Adjacent Siding Panel |
| 76 | Exterior Building Surface |
| 77 | Nails |
| 80 | Second Adjacent Siding Panel |
| 85 | Building Surface Boundary |
| 90 | Outside Corner |
| 95 | Inside Corner |
| 96 | Siding Panel Bottom Edge |
| 97 | Siding Panel Top Edge |

DESCRIPTION OF THE PREFERRED EMBODIMENTS

In order to describe the complete relationship of the invention, it is essential that some description be given to the manner and practice of functional utility and description thereof. Accordingly, the best mode for carrying out the invention is presented in terms of its preferred embodiment, herein depicted within the figures.

1. Detailed Description of the Figures

Referring now to FIGS. 1–6, depicted is a vinyl siding panel for building exteriors 30, hereinafter siding panel, according to the preferred embodiment of the present invention. The siding panel 30 is generally rectangular in shape with an inserting edge 31 opposite a siding panel receiving edge 32 along the longer of the rectangular dimensions. The siding panel 30 is folded, longitudinally, along the siding panel receiving edge 32 in a manner such as to create an S-shaped profile when viewed from either end, forming a siding panel receiving groove 33 with a siding panel nailing tab 34 protruding from the siding panel receiving edge 32. The siding panel receiving groove 33 and the siding panel nailing tab 34 span the entire length of the siding panel receiving edge 32.

A plurality of nailing slots 35 are spaced along the siding panel nailing tab 34, consisting of an elongated aperture of a width no greater than 3/16-inches and no less than 1/16-inches. A plurality of tab slots 36 are spaced along the interior of the siding panel receiving groove 33 and consist of an elongated aperture of a width no greater than 3/16-inches and no less than 1/16-inches.

A plurality of securing tabs 37, numbering equal to the number of tab slots 36, are spaced vertically along and protruding from the inserting edge 31. The securing tabs 37 are shaped in a hook-like manner, with a securing surface 38 and a supporting surface 39, facing in a downward direction along the inserting edge 31. The vertical spacing of the securing tabs 37 is such that they lie directly opposite a tab slot 36 approximately on the same horizontal axis, more specifically in a manner such that the supporting surface 39 of the securing tabs 37 lie upon the same horizontal axis as the tab slot support edge 40.

Figure 8:
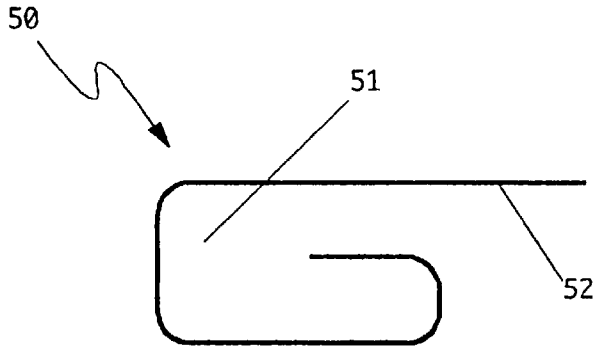
FIG. 8 is a magnified top view of a molding strip for use in conjunction with the vinyl siding panel for building exteriors according to the preferred embodiment of the present invention.
Figure 7:
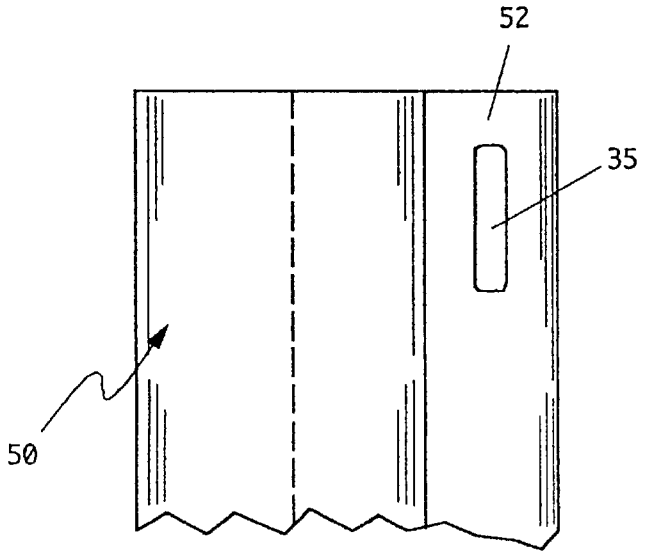
FIG. 7 is a magnified front breakaway view of a molding strip for use in conjunction with the vinyl siding panel for building exteriors according to the preferred embodiment of the present invention.
Figure 9:
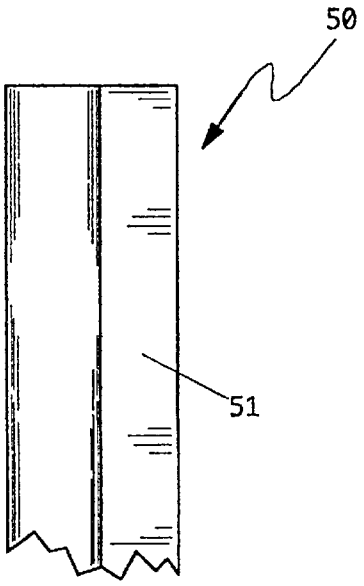
FIG. 9 is a magnified right side breakaway view of a molding strip for use in conjunction with the vinyl siding panel for building exteriors according to the preferred embodiment of the present invention.

Referring now to FIGS. 7–9, depicted is a molding strip 50 for use in conjunction with the siding panel 30 according to the preferred embodiment of the present invention. The molding strip 50 consists of a linearly elongated vinyl strip that is folded along its longitudinal axis in a manner so as to form a G-shaped profile when viewed from either end. The folds along the molding strip 50 form a molding strip receiving groove 51 and a molding strip nailing tab 52 protruding therefrom. The molding strip receiving groove 51 and the molding strip nailing tab 52 span the entire length of the molding strip 50. A plurality of nailing slots 35 are spaced along the molding strip nailing tab 52.

Figure 10:
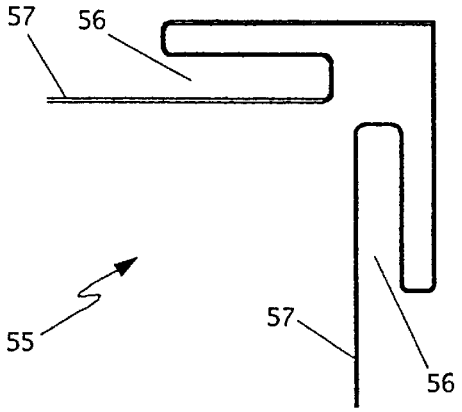
FIG. 10 is a magnified top view of an outside corner molding strip for use in conjunction with the vinyl siding panel for building exteriors according to the preferred embodiment of the present invention.
Figure 11:
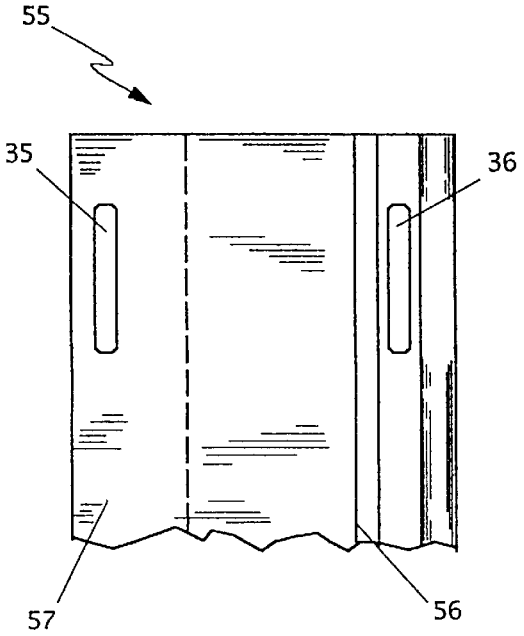
FIG. 11 is a magnified front breakaway view of an outside corner molding strip for use in conjunction with the vinyl siding panel for building exteriors according to the preferred embodiment of the present invention.
Figure 12:
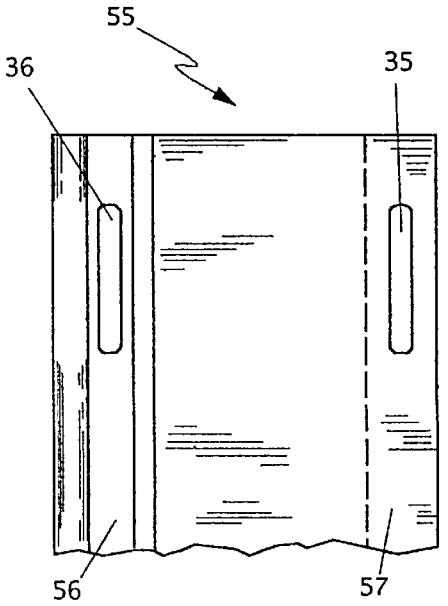
FIG. 12 is a magnified right side breakaway view of an outside corner molding strip for use in conjunction with the vinyl siding panel for building exteriors according to the preferred embodiment of the present invention.

Referring now to FIGS. 10–12, depicted is an outside corner molding strip 55 for use in conjunction with the siding panel 30 according to the preferred embodiment of the present invention. The outside corner molding strip 55 consists of a linearly elongated vinyl strip that is folded, along its longitudinal axis in a manner so as to form a profile, when viewed from either end, that resembles two S-shaped portions that oppose one another, in a mirror-imaged fashion, and at right angles. The folds along the outside corner molding strip 55 form an outside corner molding strip receiving groove 56 and an outside corner molding strip nailing tab 57 on each of the two S-shaped portions. The outside corner molding strip receiving groove 56 and the outside corner molding strip nailing tab 57 span the entire length of the outside corner molding strip 55. A plurality of nailing slots 35 are spaced along the outside corner molding strip nailing tab 57. A plurality of tab slots 36 are spaced along the interior of the outside corner molding strip receiving groove 56. The linear spacing of the tab slots 36 on the outside corner molding strip 55 is equivalent to the linear spacing of the tab slots 36 on the siding panel 30.

Figure 14:
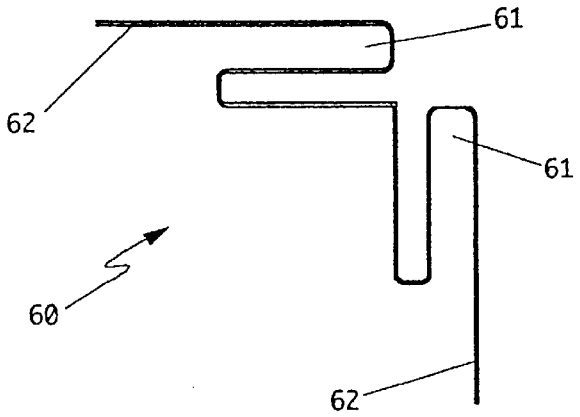
FIG. 14 is a magnified top view of an inside corner molding strip for use in conjunction with the vinyl siding panel for building exteriors according to the preferred embodiment of the present invention.
Figure 13:
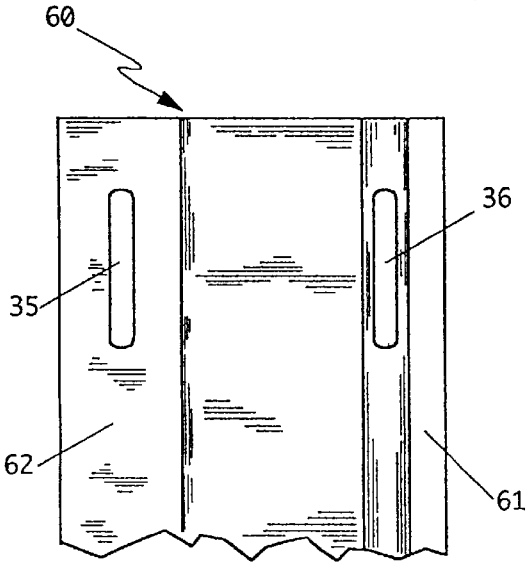
FIG. 13 is a magnified front breakaway view of an inside corner molding strip for use in conjunction with the vinyl siding panel for building exteriors according to the preferred embodiment of the present invention.
Figure 15:
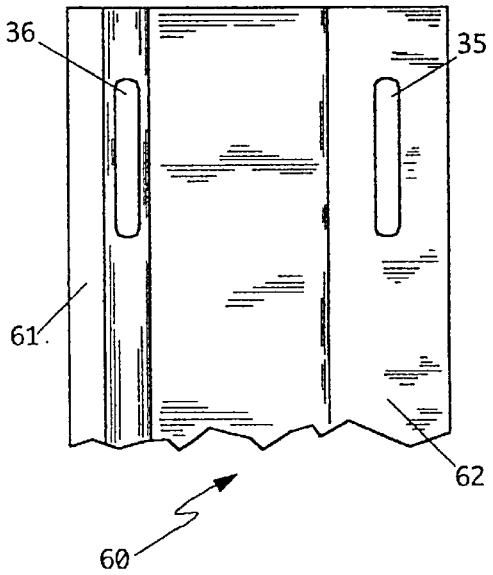
FIG. 15 is a magnified right side breakaway view of an inside corner molding strip for use in conjunction with the vinyl siding panel for building exteriors according to the preferred embodiment of the present invention.

Referring now to FIGS. 13–15, depicted is an inside corner molding strip 60 for use in conjunction with the siding panel 30 according to the preferred embodiment of the present invention. The inside corner molding strip 60 consists of a linearly elongated vinyl strip that is folded, along its longitudinal axis in a manner so as to form a profile, when viewed from either end, that resembles two to inverted S-shaped portions that oppose one another, in a mirror-imaged fashion, and at right angles. The folds along the inside corner molding strip 60 form an inside corner molding strip receiving groove 61 and an inside corner molding strip nailing tab 62 on each of the two S-shaped portions. The inside corner molding strip receiving groove 61 and the inside corner molding strip nailing tab 62 span the entire length of the inside corner molding strip 60. A plurality of nailing slots 35 are spaced along the inside corner molding strip nailing tab 62. A plurality of tab slots 36 are spaced along the interior of the inside corner molding strip receiving groove 61. The linear spacing of the tab slots 36 on the inside corner molding strip 60 is equivalent to the linear spacing of the tab slots 36 on the siding panel 30.

Figure 16:
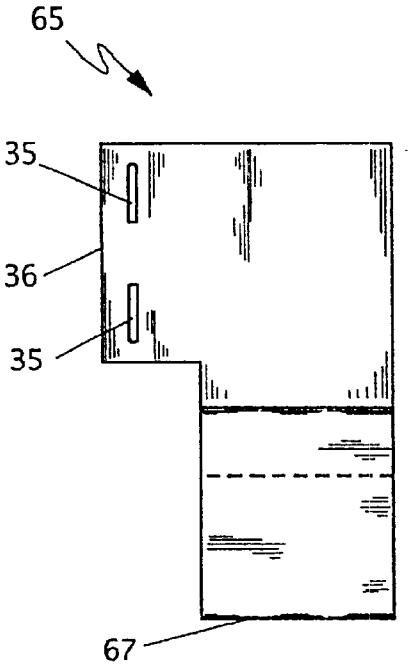
FIG. 16 is a front view of a bottom stabilizing bracket for use in conjunction with the vinyl siding panel for building exteriors according to the preferred embodiment of the present invention.
Figure 17:
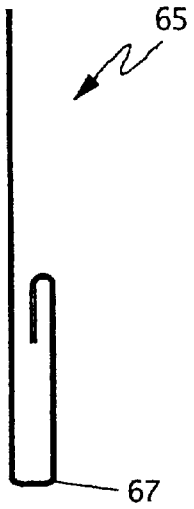
FIG. 17 is a side view of a bottom stabilizing bracket for use in conjunction with the vinyl siding panel for building exteriors according to the preferred embodiment of the present invention.

Referring now to FIGS. 16 and 17, depicted is a bottom stabilizing bracket 65 for use in conjunction with the siding panel 30 according to the preferred embodiment of the present invention. The bottom stabilizing bracket 65 consists of a vinyl plate having a generally L-shaped appearance created by two adjacent rectangular regions, with a bottom bracket connecting edge 66 and a bottom bracket supporting end 67. A plurality of nailing slots 35 are spaced along bottom bracket the connecting edge 66. The bottom stabilizing bracket 65 is folded horizontally, defining the bottom bracket supporting end 67, in a manner so as to form a G-shaped profile when viewed from either end. The folds along the bottom support bracket 65 form a bottom bracket receiving groove 68.

Figure 18:
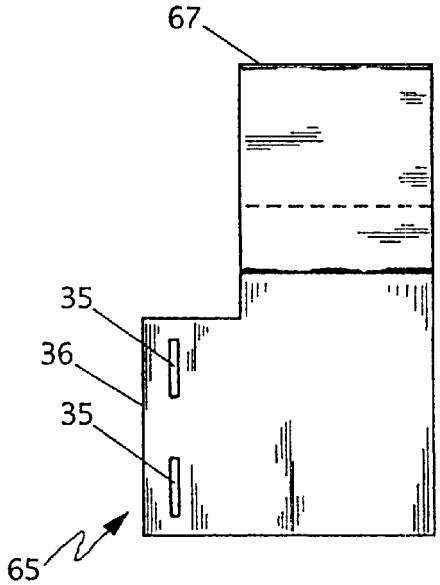
FIG. 18 is a front view of a top stabilizing bracket for use in conjunction with the vinyl siding panel for building exteriors according to the preferred embodiment of the present invention.
Figure 19:
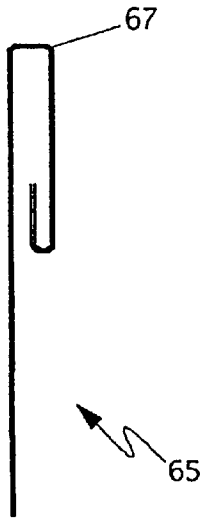
FIG. 19 is a side view of a top stabilizing bracket for use in conjunction with the vinyl siding panel for building exteriors according to the preferred embodiment of the present invention.

Referring now to FIGS. 18 and 19, depicted is a top stabilizing bracket 70 for use in conjunction with the siding panel 30 according to the preferred embodiment of the present invention. The top stabilizing bracket 70 consists of a vinyl plate having a generally L-shaped appearance created by two adjacent rectangular regions, with a top bracket connecting edge 71 and a top bracket supporting end 72. A plurality of nailing slots 35 are spaced along the top bracket connecting edge 71. The top stabilizing bracket 70 is folded horizontally, defining the top bracket supporting end 72, in a manner so as to form a G-shaped profile when viewed from either end. The folds along the top support bracket 70 form a top bracket receiving groove 73.

2. Operation of the Preferred Embodiment

In accordance with the preferred embodiment of the present invention, siding panels 30 are used to cover the exterior surface of buildings and the like. The siding panels 30 interlock with adjacent siding panels 30 while molding strips 50, outside corner molding strips 55 and inside corner molding strips 60 are used to trim edges on windows, door frames and the like and provide additional support for the panels. Bottom stabilizing brackets 65 and top stabilizing brackets 70 also provide additional support for the panels.

Figure 20A:
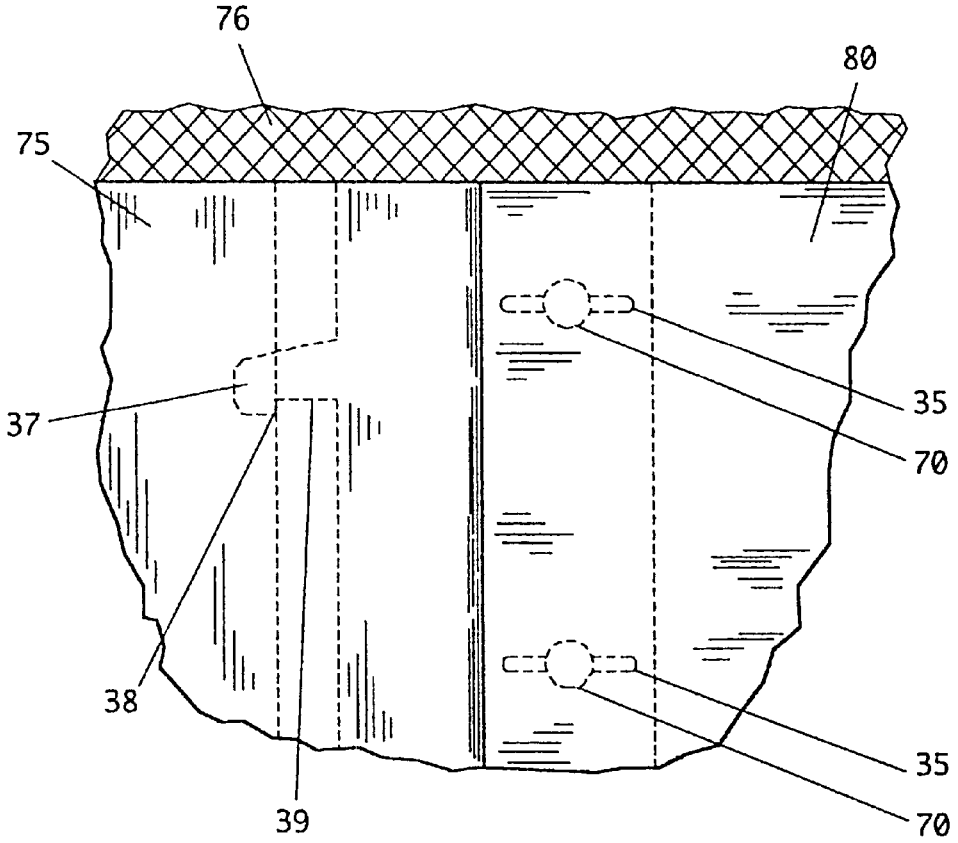
FIG. 20*a* is a magnified front breakaway view of the slot and tab connecting means, incorporated in the vinyl siding panel for building exteriors, in use according to the preferred embodiment of the present invention.
Figure 20B:
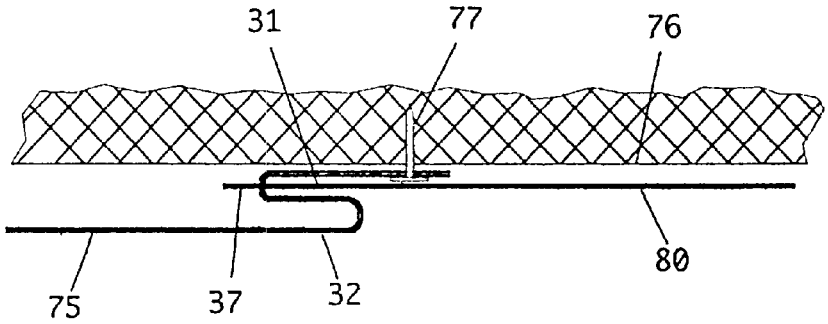
FIG. 20*b* is a magnified top breakaway view of the slot and tab connecting means, incorporated in the vinyl siding panel for building exteriors, in use according to the preferred embodiment of the present invention.

Referring now to FIGS. 20*a* and 20*b*, depicted is the means by which adjacent siding panels 30 are secured to an exterior building surface 76, according to the preferred embodiment of the present invention. A first adjacent siding panel 75 is secured to the exterior building surface 76 via nails 77 driven through the nailing slots 35 along the receiving edge 32. A second adjacent siding panel 80 is secured to the exterior building surface 76, at the inserting edge 31, via securing tabs 37 inserted through the tab slots 36 of the first adjacent siding panel 75. The weight of the second adjacent siding panel 80 is supported by the supporting surface 39 of the securing tab 37 which rests upon the tab slot support edge 40. The securing tabs 37 of second adjacent siding panel 80 are held in place within the tab slots 36 by the securing surface 38.

Figure 21:
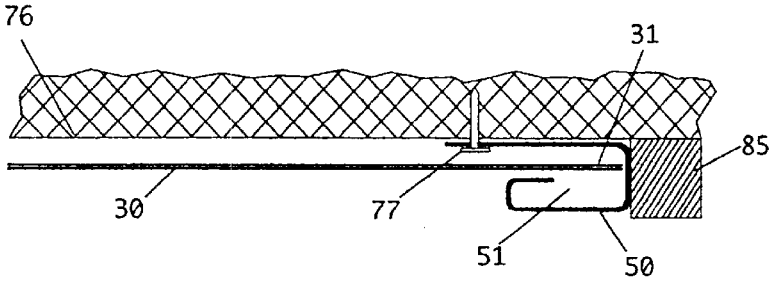
FIG. 21 is a top breakaway view of a molding strip installed on a building exterior and used in conjunction with the vinyl siding panel for building exteriors, according to the preferred embodiment of the present invention.

Referring now to FIG. 21, depicted is the means by which a molding strip 50 is used in conjunction with a siding panel 30, according to the preferred embodiment of the present invention. The molding strip 50 is placed adjacent to a building surface boundary 85, such as a window, door frame or the like. The molding strip 50 is attached to the exterior building surface 76 via nails 77 driven through the nailing slots 35 located along the molding strip nailing tab 52. The siding panel 30 is placed into the molding strip receiving groove 51 and is secured to the exterior building surface 76, at the inserting edge 31, via bottom stabilizing brackets 65 and top stabilizing brackets 70 attached to the exterior building surface 76 in a position hidden from view by the molding strip receiving groove 51. Once the inserting edge 31 is secured, the siding panel nailing tab 34 is secured to the exterior building surface 76 with nails. Thus, the weight of the siding panel 30 is supported by the siding panel nailing tab 34, bottom stabilizing brackets 65 and top stabilizing brackets 70.

Figure 22:
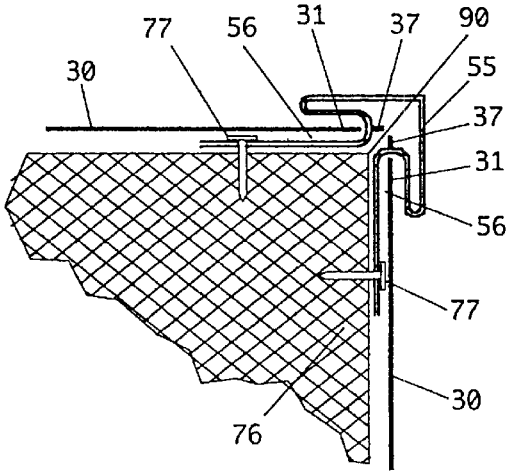
FIG. 22 is a top breakaway view of an outside corner molding strip installed on a building exterior and used in conjunction with the vinyl siding panel for building exteriors, according to the preferred embodiment of the present invention.

Referring now to FIG. 22, depicted is the means by which an outside corner molding strip 55 is used in conjunction with a pair of siding panels 30, according to the preferred embodiment of the present invention. The outside corner molding strip 55 is attached to an outside corner 90 of the exterior building surface 76 via nails 77 driven through the nailing slots 35 located along the outside corner molding strip nailing tab 57. The siding panels 30 are inserted into the outside corner molding strip receiving groove 56 and secured to the exterior building surface 76, at the inserting edge 31, via securing tabs 37 inserted through the tab slots 36 of the outside corner molding strip 55. The weight of the siding panel 30 is supported by the supporting surface 39 of the securing tab 37, resting upon the tab slot support edge 40. The securing tabs 37 of siding panel 30 are held in place within the tab slots 36 by the securing surface 38.

In the case where the siding panel receiving edge 32 or a cut edge resulting from a partial panel need engage with the outside corner molding strip 55, additional measures are required to secure the siding panel 30 therein. The siding panel receiving edge 32 is placed into the outside corner molding strip receiving groove 56 and is secured to the exterior building surface 76 via bottom stabilizing brackets 65 and top stabilizing brackets 70 attached to the exterior building surface 76 in a position hidden from view by the outside corner molding strip receiving groove 56.

Figure 23:
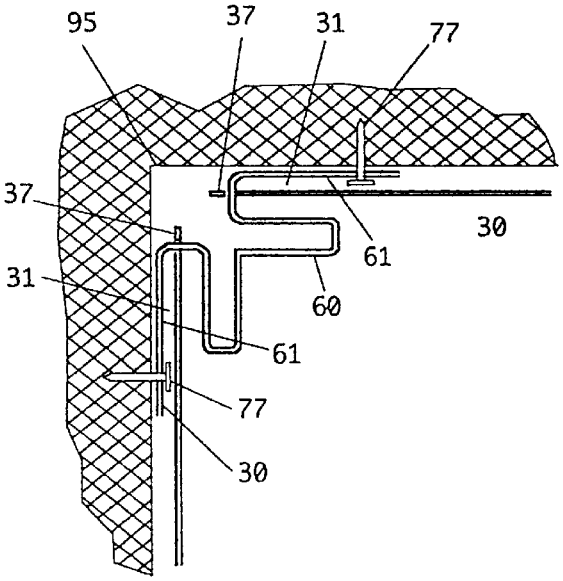
FIG. 23 is a top breakaway view of an inside corner molding strip installed on a building exterior and used in conjunction with the vinyl siding panel for building exteriors, according to the preferred embodiment of the present invention.

Referring now to FIG. 23, depicted is the means by which an inside corner molding strip 60 is used in conjunction with a pair of siding panels 30, according to the preferred embodiment of the present invention. The inside corner molding strip 60 is attached to an inside corner 95 of the exterior building surface 76 via nails 77 driven through the nailing slots 35 located along the inside corner molding strip nailing tab 62. The siding panels 30 are inserted into the inside corner molding strip receiving groove 61 and secured to the exterior building surface 76, at the inserting edge 31, via securing tabs 37 inserted through the tab slots 36 of the inside corner molding strip 60. The weight of the siding panel 30 is supported by the supporting surface 39 of the securing tab 37, resting upon the tab slot support edge 40. The securing tabs 37 of siding panel 30 are held in place within the tab slots 36 by the securing surface 38.

In the case where the siding panel receiving edge 32 or a cut edge resulting from a partial panel need engage with the inside corner molding strip 60, additional measures are required to secure the siding panel 30 therein. The siding panel receiving edge 32 is placed into the inside corner molding strip receiving groove 61 and is secured to the exterior building surface 76 via bottom stabilizing brackets 65 and top stabilizing brackets 70 attached to the exterior building surface 76 in a position hidden from view by the inside corner molding strip receiving groove 61.

Figure 24:
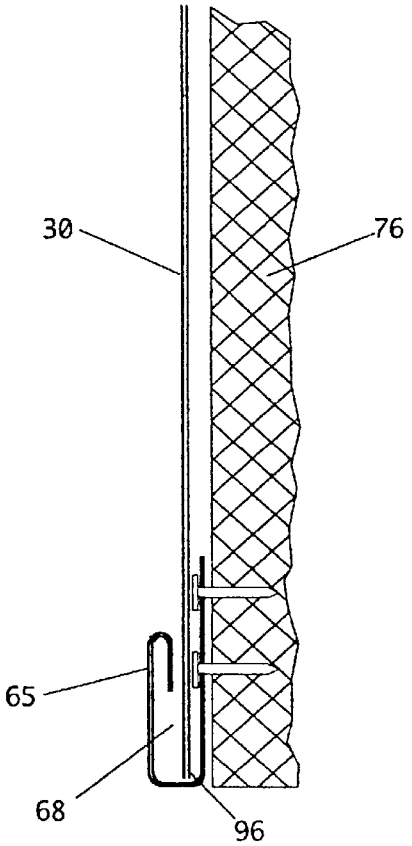
FIG. 24 is a side view of a bottom stabilizing bracket installed on a building exterior and used in conjunction with the vinyl siding panel for building exteriors, according to the preferred embodiment of the present invention.
Figure 25:
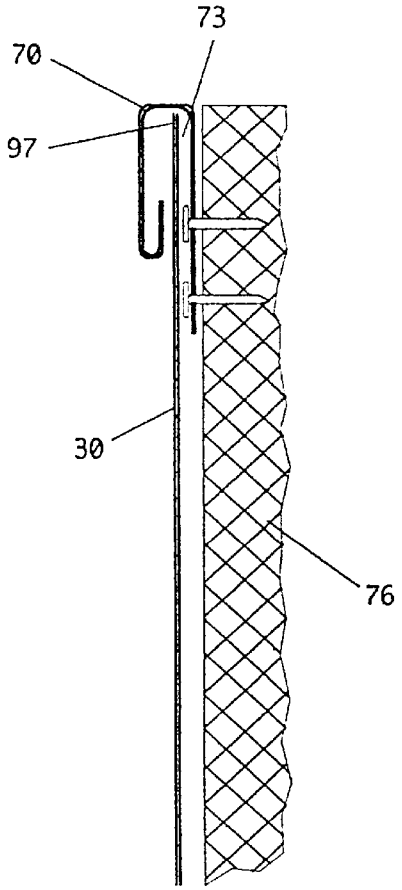
FIG. 25 is a side view of top stabilizing bracket installed on a building exterior and used in conjunction with the vinyl siding panel for building exteriors, according to the preferred embodiment of the present invention.

Referring now to FIGS. 24 and 25, depicted is the means by which a bottom stabilizing bracket 65 and a top stabilizing bracket 70 are used in conjunction with siding panels 30, according to the preferred embodiment of the present invention. The bottom stabilizing bracket 65 and the top stabilizing bracket 70 are attached to the exterior building surface 76 via nails 77 driven through the nailing slots 35 located along the bottom bracket connecting edge 66 and the top bracket connecting edge 71, respectively. Referring to the bottom stabilizing bracket 65, the siding panels 30 are secured to the exterior building surface 76 by placing the siding panel bottom edge 96 of the siding panel 30 in the bottom bracket receiving groove 68. Referring to the top stabilizing bracket 70, the siding panels 30 are secured to the exterior building surface 76 by placing the siding panel top edge 97 of the siding panel 30 in the top bracket receiving groove 73.

While the preferred embodiments of the invention have been shown, illustrated, and described, it will be apparent to those skilled in this field that various modifications may be made in these embodiments without departing from the spirit of the present invention. It is for this reason that the scope of the invention is set forth in and is to be limited only by the following claims.

What is claimed is:

1. A siding panel system wherein large sheets of siding material, rather than strips, are used in conjunction with a series of edge and corner trimming strips and support brackets to provide a protective and decorative covering for building exterior surfaces, said siding panel system comprising:

a siding panel, said siding panel generally rectangular in shape having a top edge opposite a bottom edge and having a siding panel inserting edge opposite a siding panel receiving edge, wherein said top edge and said bottom edge lie along the shortest rectangular dimensions of said siding panel and wherein said siding panel inserting edge and said siding panel receiving edge lie along the longest rectangular dimensions of said siding panel, said siding panel being folded along its longitudinal axis on said siding panel receiving edge, producing an S-shaped profile when viewed from either end and forming a siding panel receiving groove and a siding panel nailing tab, wherein said siding panel receiving groove is capable of accepting and receiving said siding panel inserting edge of an adjacent siding panel and said siding panel nailing tab further comprises a series of equidistantly spaced siding panel nailing slots, said siding panel nailing slots comprising linearly elongated apertures arranged perpendicular to the longitudinal axis of said siding panel and of a size allowing passage therethrough of a house siding securing means selected from the group comprising nails and screws, said siding panel having a plurality of siding panel tab slots spaced along said siding panel receiving groove and a plurality of siding panel securing tabs, equal in number and spacing to that of said siding panel tab slots, along said siding panel inserting edge and protruding therefrom, said siding panel tab slots comprising a linearly elongated aperture arranged parallel to the longitudinal axis of said siding panel, having a siding panel tab slot support edge located on the portion of the interior surface of said siding panel tab slot nearest said bottom edge, and of a size allowing passage of said siding panel securing tabs therethrough, and wherein said siding panel securing tabs have a hook-like shape, with a securing surface and a supporting surface, said siding panel securing tabs arranged such that said supporting surface of said siding panel securing tabs lie upon the same horizontal axis as said siding panel tab slot support edge, a molding strip, said molding strip having a generally linearly elongated shape and wherein said molding strip is folded along its longitudinal axis, producing a G-shaped profile when viewed from either end and forming a molding strip receiving groove and a molding strip nailing tab along the longitudinal axis thereof, wherein said molding strip receiving groove accepts and secures said siding panel inserting edge, said molding strip nailing tab further comprising a series of equidistantly spaced molding strip nailing slots, said molding strip nailing slots comprising a linearly elongated aperture arranged perpendicular to the longitudinal axis of said molding strip and of a size allowing passage therethrough of a house siding securing means, selected from the group comprising nails and screws;

a bottom stabilizing bracket, said bottom stabilizing bracket having a generally L-shaped appearance created by two adjacent rectangular regions, forming a bottom bracket connecting edge opposite a bottom bracket supporting end, wherein said bottom bracket supporting end accepts and secures said bottom edge of side siding panel;

a top stabilizing bracket, said top stabilizing bracket having a generally L-shaped appearance created by two adjacent rectangular regions, forming a top bracket connecting edge opposite a top bracket supporting end, wherein said top bracket supporting end accepts and secures said top edge of side siding panel;

an outside corner molding strip having a generally linearly elongated shape and wherein said outside corner molding strip is folded along its longitudinal axis in a manner so as to form a profile that, when viewed from either end, resembles two S-shaped portions that oppose one another, in a mirror-imaged fashion, and at right angles, forming a first outside corner molding strip receiving groove, a second outside corner molding strip receiving groove, a first outside corner molding strip nailing tab and a second outside corner molding strip nailing tab, wherein said first outside corner molding strip receiving groove accepts and secures said siding panel inserting edge and wherein said second outside corner molding strip receiving groove accepts and secures said siding panel inserting edge; and an inside corner molding strip having a generally linearly elongated shape and wherein said inside corner molding strip is folded along its longitudinal axis in a manner so as to form a profile that, when viewed from either end, resembles two inverted S-shaped portions that oppose one another, in a mirror-imaged fashion, and at right angles, forming a first inside corner molding strip receiving groove, a second inside corner molding strip receiving groove, a first inside corner molding strip nailing tab and a second inside corner molding strip nailing tab, wherein said first inside corner molding strip receiving groove accepts and secures said siding panel inserting edge and wherein said second inside corner molding strip receiving groove accepts and secures said siding panel inserting edge.

2. The siding panel system of claim 1, wherein said siding panel tab slots are capable of accepting and receiving said siding panel securing tabs therethrough, providing a securing means between adjacent panels wherein said supporting surface of said siding panel securing tab lies upon and is supported by said siding panel tab slot support edge and wherein said securing surface of said siding panel securing tab engages with the inside perimeter surface of said siding panel tab slot at said siding panel tab slot support edge.

3. The siding panel system of claim 1, wherein said outside corner molding strip further comprises a plurality of outside corner molding strip tab slots arranged along said first outside corner molding strip receiving groove and along said second outside corner molding strip receiving groove, and spaced in a manner equivalent to that of said siding panel securing tab slots, said outside corner molding strip tab slots comprising linearly elongated apertures arranged parallel to the longitudinal axis of said outside corner molding strip, having an outside corner molding strip tab slot support edge located on the bottom portion of the interior surface of said outside corner molding strip tab slot when said outside corner molding strip is oriented in a vertical manner, and wherein said first outside corner molding strip nailing tab and said second outside corner molding strip nailing tab further comprises a series of equidistantly spaced outside corner molding strip nailing slots, said outside corner molding strip nailing slots comprising linearly elongated apertures arranged perpendicular to the longitudinal axis of said outside corner molding strip and of a size allowing passage therethrough of a house siding securing means selected from the group comprising nails and screws.

4. The siding panel system of claim 3, wherein said outside corner molding strip tab slots are capable of accepting and receiving said siding panel securing tabs therethrough, providing a securing means between said siding panels and said outside corner molding strips wherein said supporting surface of said siding panel securing tab lies upon and is supported by said outside corner molding strip tab slot support edge and wherein said securing surface of said siding panel securing tab engages with the inside perimeter surface of said outside corner molding strip tab slot at said outside corner molding strip tab slot support edge.

5. The siding panel system of claim 1, wherein said inside corner molding strip further comprises a plurality of inside corner molding strip tab slots arranged along said first inside corner molding strip receiving groove and along said second inside corner molding strip receiving groove and spaced in a manner equivalent to that of said siding panel securing tab slots, said inside corner molding strip tab slots comprising linearly elongated apertures arranged parallel to the longitudinal axis of said inside corner molding strip, having an inside corner molding strip tab slot support edge located on the bottom portion of the interior surface of said inside corner molding strip tab slot when said inside corner molding strip is oriented in a vertical manner, and wherein said first inside corner molding strip nailing tab and said second inside corner molding strip nailing tab further comprises a series of equidistantly spaced inside corner molding strip nailing slots, said inside corner molding strip nailing slots comprising linearly elongated apertures arranged perpendicular to the longitudinal axis of said inside corner molding strip and of a size allowing passage therethrough of a house siding securing means selected from the group comprising nails and screws.

6. The siding panel system of claim 5, wherein said inside corner molding strip tab slots are capable of accepting and receiving said siding panel securing tabs therethrough, providing a securing means between said siding panels and said inside corner molding strips wherein said supporting surface of said siding panel securing tab lies upon and is supported by said inside corner molding strip tab slot support edge and wherein said securing surface of said siding panel securing tab engages with the inside perimeter surface of said inside corner molding strip tab slot at said inside corner molding strip tab slot support edge.

7. The siding panel system of claim 1, wherein said bottom stabilizing bracket is folded along said bottom stabilizing bracket support end, producing an G-shaped profile when viewed from either end and forming a bottom stabilizing bracket receiving groove, and wherein a plurality of bottom stabilizing bracket nailing slots are located at said bottom support bracket connecting edge, said bottom stabilizing bracket nailing slots comprising linearly elongated apertures arranged parallel to said bottom stabilizing bracket supporting end and of a size allowing passage therethrough of a house siding securing means selected from the group comprising nails and screws.

8. The siding panel system of claim 7, wherein said bottom stabilizing bracket is capable of accepting and receiving said bottom edge of said siding panel in said bottom stabilizing bracket receiving groove, providing a securing means between said siding panels and said bottom stabilizing bracket wherein said bottom edge lies upon and is supported by said bottom stabilizing bracket receiving groove.

9. The siding panel system of claim 1, wherein said top stabilizing bracket is folded along said top stabilizing bracket support end, producing an G-shaped profile when viewed from either end and forming a top support bracket receiving groove, and wherein a plurality of top stabilizing bracket nailing slots are located at said top support bracket connecting edge, said top stabilizing bracket nailing slots comprising linearly elongated apertures arranged parallel to said top stabilizing bracket supporting end and of a size allowing passage therethrough of a house siding securing means selected from the group comprising nails and screws.

10. The siding panel system of claim 9, wherein said top stabilizing bracket is capable of accepting and receiving said top edge of said siding panel in said top stabilizing bracket receiving groove, providing a securing means between said siding panels and said top stabilizing bracket wherein said top edge lies in and is supported by said top stabilizing bracket receiving groove.

* * * * *